US006659915B2

(12) United States Patent
Klein

(10) Patent No.: US 6,659,915 B2
(45) Date of Patent: Dec. 9, 2003

(54) EXERCISE MACHINE

(76) Inventor: Steven B. Klein, 6620 Garrett Rd., Rockville, MD (US) 20855

( * ) Notice: Subject to any disclaimer, the term of this patent is extended or adjusted under 35 U.S.C. 154(b) by 378 days.

(21) Appl. No.: 09/733,993

(22) Filed: Dec. 12, 2000

(65) Prior Publication Data

US 2002/0072454 A1 Jun. 13, 2002

(51) Int. Cl.[7] ..... A63B 71/00
(52) U.S. Cl. ..... 482/51; 482/57
(58) Field of Search ..... 482/51–54, 57, 482/70

(56) References Cited

U.S. PATENT DOCUMENTS

| | | | | |
|---|---|---|---|---|
| 5,129,873 | A | | 7/1992 | Henderson et al. |
| 5,254,059 | A | | 10/1993 | Arthur et al. |
| 5,322,491 | A | | 6/1994 | Wanzer et al. |
| 5,685,804 | A | | 11/1997 | Whan-Tong et al. |
| D405,852 | S | | 2/1999 | McBride |
| 5,865,712 | A | * | 2/1999 | Chang ..... 482/57 |
| 5,897,458 | A | | 4/1999 | Farhat |
| 6,042,512 | A | | 3/2000 | Eschenbach |
| 6,053,847 | A | | 4/2000 | Stearns et al. |
| 6,063,008 | A | | 5/2000 | McBride et al. |
| 6,077,198 | A | | 6/2000 | Eschenbach |
| D429,781 | S | | 8/2000 | Arnold et al. |
| 6,123,650 | A | | 9/2000 | Birrell |

FOREIGN PATENT DOCUMENTS

EP 0813895 A2 12/1997

* cited by examiner

*Primary Examiner*—Nicholas D. Lucchesi
*Assistant Examiner*—Tam Nguyen
(74) *Attorney, Agent, or Firm*—Richard C. Litman

(57) ABSTRACT

An improved leg exercise apparatus by modifying a conventional apparatus to improve its durability and substantially eliminate the existing problem of a rocking motion. First, the foot ramps are reinforced underneath by double brackets and a plurality of wave washers. Second, each stair arm has its bushings replaced by needle or roller bearings and self lubricating, sealing washers which are attached to the flywheel pins. Third, the lower portion of the lift motor may be stabilized to prevent any forward or rearward motion.

10 Claims, 4 Drawing Sheets

EXERCISE MACHINE

BACKGROUND OF THE INVENTION

1. Field of the Invention

The present invention relates generally to exercise apparatus. More specifically, the invention includes modifications to an existing exercise apparatus to add strengthening parts and replace others so as to provide an improved exercise apparatus.

2. Description of the Related Art

The related art of interest describes various exercise apparatus, but none discloses the present invention. First, there is a need for an exercise apparatus having a sturdier foot ramp support, through relocation and provision of a pair of lift guide and bracket assemblies, together with new lower lift shafts or arms. This greatly reduces and virtually eliminates rocking motion which leads to wear. Second, changing each stair arm original "Oilite" bushings, where the stair arm is attached to the rear flywheel, with needle or roller type bearings, and then sealing these new bearings with "Oilite" washers, provides a smoother feel to the machine, with less resistance and superior wearability. It is believed that the first change allows the installation of the second change, it being formerly believed that the use of needle or roller type bearings would lead to premature failure of such bearings in a machine with rocking motion imparted by use. However, it may be that the two changes of this invention may be somewhat independent of each other. A third improvement that may be included is to stabilize the lift motor so that it does not move forward or backward.

The related art will be discussed in the order of perceived relevance to the present invention.

U.S. Pat. No. 5,685,804 issued on Nov. 11, 1997, to Janine Whan-Tong et al. describes a stationary exercise device comprising a pair of foot engaging links supported at their rear ends by flywheels and at their front ends along a U-shaped guide. The front ends have concave rollers for traversing the guide. The attachment of the foot links to the flywheels are by fasteners through collars. The device is distinguishable for its lack of reinforcement between the roller tube sections in the front housing and the track of the guide, and the simple flywheel connections to the foot links.

U.S. Pat. No. 5,897,458 issued on Apr. 27, 1999, to Joseph E. Farhat describes a device for improving an exercise machine by installing wear resistant devices and a plurality of frictionless bearings within a sleeve for a pedal arm (col. 6, lines 3–5), and a shielding mechanism to guard the mechanical components from environmental contamination and enable draining of fluids from vital mechanical parts. The improvement device relative to the additional frictionless bearings is distinguishable because roller bearings and lubricating washers were not suggested.

U.S. Pat. No. 5,254,059 issued on Oct. 19, 1993, to Brian A. Arthur et al. describes a simplified exercise apparatus with shock absorbing mounting brackets connected to the foot beams of the apparatus. The apparatus is distinguishable for its reliance on shock absorbing hydraulic cylinders.

U.S. Design Patent No. 405,852 issued on Feb. 16, 1999, to Robert W. McBride describes an elliptical motion exerciser rider machine having an elongated bracket under each pedal arm enabling travel while the rear end of each pedal arm rotates on a crankshaft. The machine is distinguishable for its elongated brackets.

U.S. Design Patent No. 429,781 issued on Aug. 22, 2000, to Peter Arnold et al. describes a crosstrainer apparatus wherein the stair arms supporting pedals travel on fixed foot ramps. The apparatus is distinguishable for its fixed foot ramps.

U.S. Pat. No. 5,129,873 issued on Jul. 14, 1992, to William C. Henderson et al. describes an exercise apparatus comprising a cantilevered pair of foot pad bearing foot beams oscillating from hydraulic cylinders attached to an upright post with a handle. The apparatus is distinguishable for its hydraulic cylinder system.

U.S. Pat. No. 5,322,491 issued on Jun. 21, 1994, to Richard A. Wanzer et al. describes an exercise apparatus with reciprocating levers coupled by resilient linkage for semi-dependent action. The foot platforms are mounted on levers connected to a drive pulley for a flywheel in the resistance mechanism which also contains a coil spring and a cable. The apparatus is distinguishable for its structure of a coil spring, cable and flywheel.

U.S. Pat. No. 6,042,512 issued on Mar. 28, 2000, and U.S. Pat. No. 6,077,198 issued on Jun. 20, 2000, to Paul W. Eschenbach describes a variable lift cross trainer exerciser apparatus comprising a foot support member guided by a roller at one end and driven by a crank linkage on the other end. The pedal motion has less sever pedal angles. The pair of handles are coupled to the foot support member with connector links for coordinated arm exercise. The apparatus is distinguishable for its connected arms and feet exercising structure.

U.S. Pat. No. 6,053,847 issued on Apr. 25, 2000, to Kenneth W. Stearns et al. describes an elliptical exercise apparatus comprising a pair of handles connected to a pair of foot supporting members by a crank assembly. The apparatus is distinguishable for its connected arms and feet exercising assembly.

U.S. Pat. No. 6,063,008 issued on May 16, 2000, to Robert W. McBride et al. describes an elliptical motion exercise apparatus comprising a pair of pedal assemblies riding on a bearing assembly, wherein each pedal assembly includes a closed bracket at one end and connected to a crank assembly at the opposite end. The separate handles can be connected to each pedal assembly. The apparatus is distinguishable for lacking a vertically movable front bearing assembly.

U.S. Pat. No. 6,123,650 issued on Sep. 26, 2000, to James S. Birrell describes an independent elliptical motion exerciser apparatus comprising a pair of foot link members riding on a transverse axle of a flywheel and each foot link hinged to a guide ramp on a spring or a pulley or belt system. The apparatus is distinguishable for its guide ramps lacking a horizontal and vertically moving support.

E.P.O. Patent Application No. 0 813 895 A2 published on Dec. 29, 1997, for Allan L. Ryan et al. describes a cross training apparatus comprising a pair of arm handles which moves in synchronism with the pedal members. The apparatus is distinguishable for its coupled arm handles.

None of the above inventions and patents, taken either singularly or in combination, is seen to describe the instant invention as claimed. Thus, an improved exercise apparatus solving the aforementioned problems is desired.

SUMMARY OF THE INVENTION

The present invention is directed to a modification of an existing exercise apparatus to improve its reliability by making a sturdier arrangement, firstly, to minimize the travel for the lift guide, by relocating it, and by reinforcing the supporting bracket and lower lift shaft or arm with wave washers and plastic (preferably Delrin) spacers. Consequently, the modifications minimize rocking and wear of the machine. Secondly, replacement of the conventional bushings in each stair arm with needle or roller bearings and lubricant washers also minimizes the wearing down of the flywheel pins upon which the stair arms spin and makes the machine run far more smoothly. Thirdly, the lift motor may be stabilized so that it does not move forward and/or backward.

Firstly, with unmodified exercise machine, the travel of the lift guide and bracket is about 10 inches, and is a rocking type of travel whether elevating or descending. The rocking motion is inherent when a user is in motion or striding, then elevating or descending the ramps. In the instant invention, the travel is reduced from 10 inches to about 2.5 inches, with consequent, greatly reduced rocking. This in turn eliminates the former side-to-side play transferred to the rear stair arm connection to the rear flywheel. Secondly, the conventional bushings at this connection are replaced with needle or roller bearings sealed with Oilite washers. This, in combination with the first change, has a profound effect on the smoothness and sturdiness of the machine in operation. This permits a user to work at higher levels of intensity, while reducing back stress and stress on the user's knee joints. Thirdly, the lift motor is stabilized so that the entire motor is prevented from moving forward or backward.

Accordingly, it is a principal object of the invention to provide an improved exercise apparatus which is more durable by relocating and reorienting one part, replacing a second part, and reinforcing a third part.

It is another object of the invention is to provide an improved exercise apparatus with a first modification of the lift or elevation system by modifying the support bracket under each ramp.

It is a further object of the invention is to provide an improved exercise apparatus with a second modification of the stair arm and flywheel pin connection by replacing the conventional "Oilite" bushings machine pressed into the stair arms with needle or roller bearings with Oilite washers to seal the bearings.

Still another object of the invention is to provide an improved exercise apparatus with a third modification of stabilizing the lower portion of the lift motor so it does not move forward or backward.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 4:
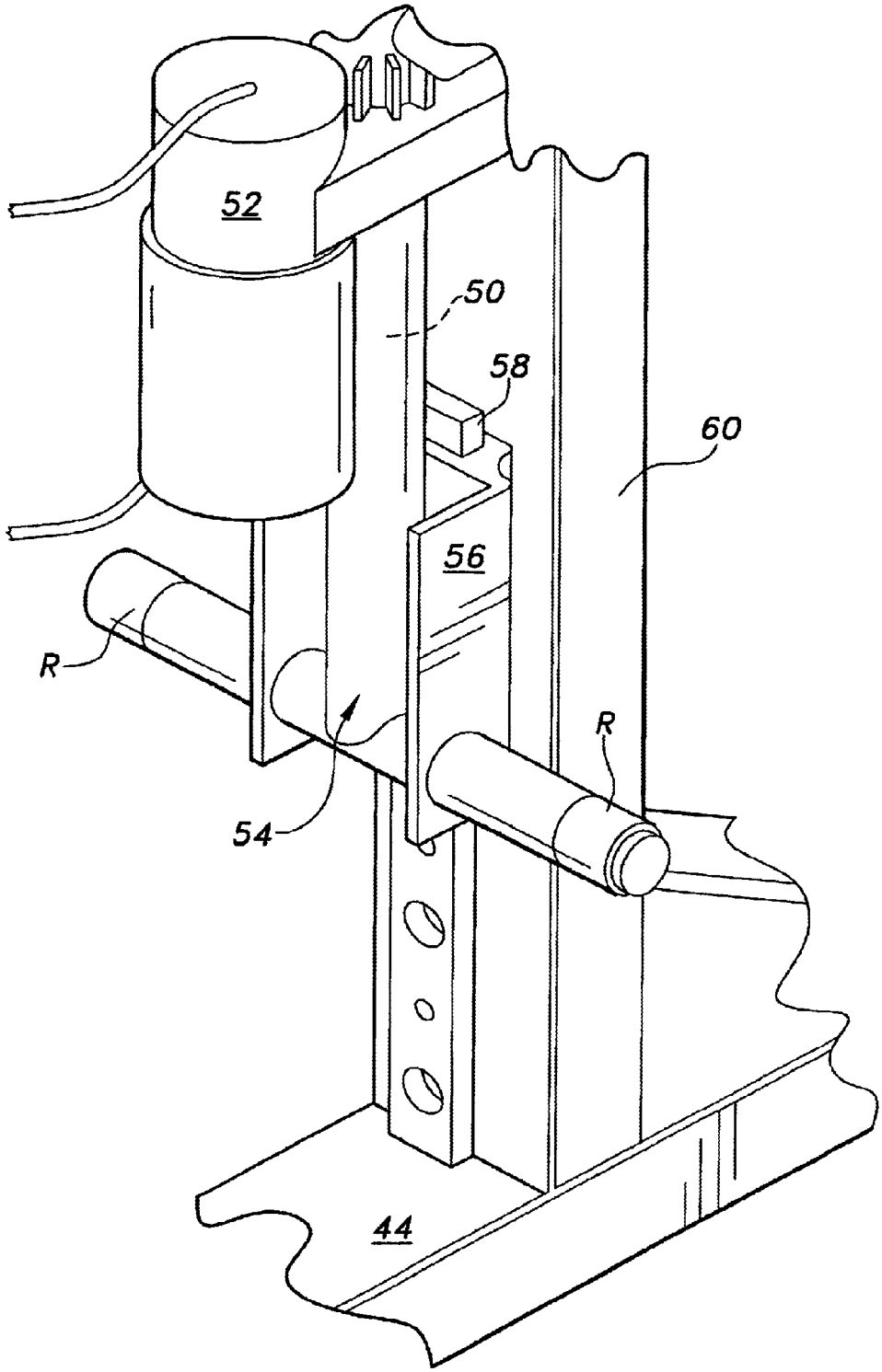
FIG. 4 ( PRIOR ART )
FIG. 4 is a side elevational view of conventional structure, including the lift arm tube.

The present invention is directed to the improvement of a conventional elliptical fitness cross trainer apparatus, e.g., Precor EFX Model No. 544, by making three modifications to substantially eliminate the existing rocking motion by (1) strengthening each foot ramp, (2) replacing the stair arm bushings with needle or roller bearings made by Torrington Part No. B-2012 or 2016, and (3) stabilizing the lower portion of the lift motor; the top portion is already attached, as shown in FIG. 4, and will remain the same.

Figure 1:
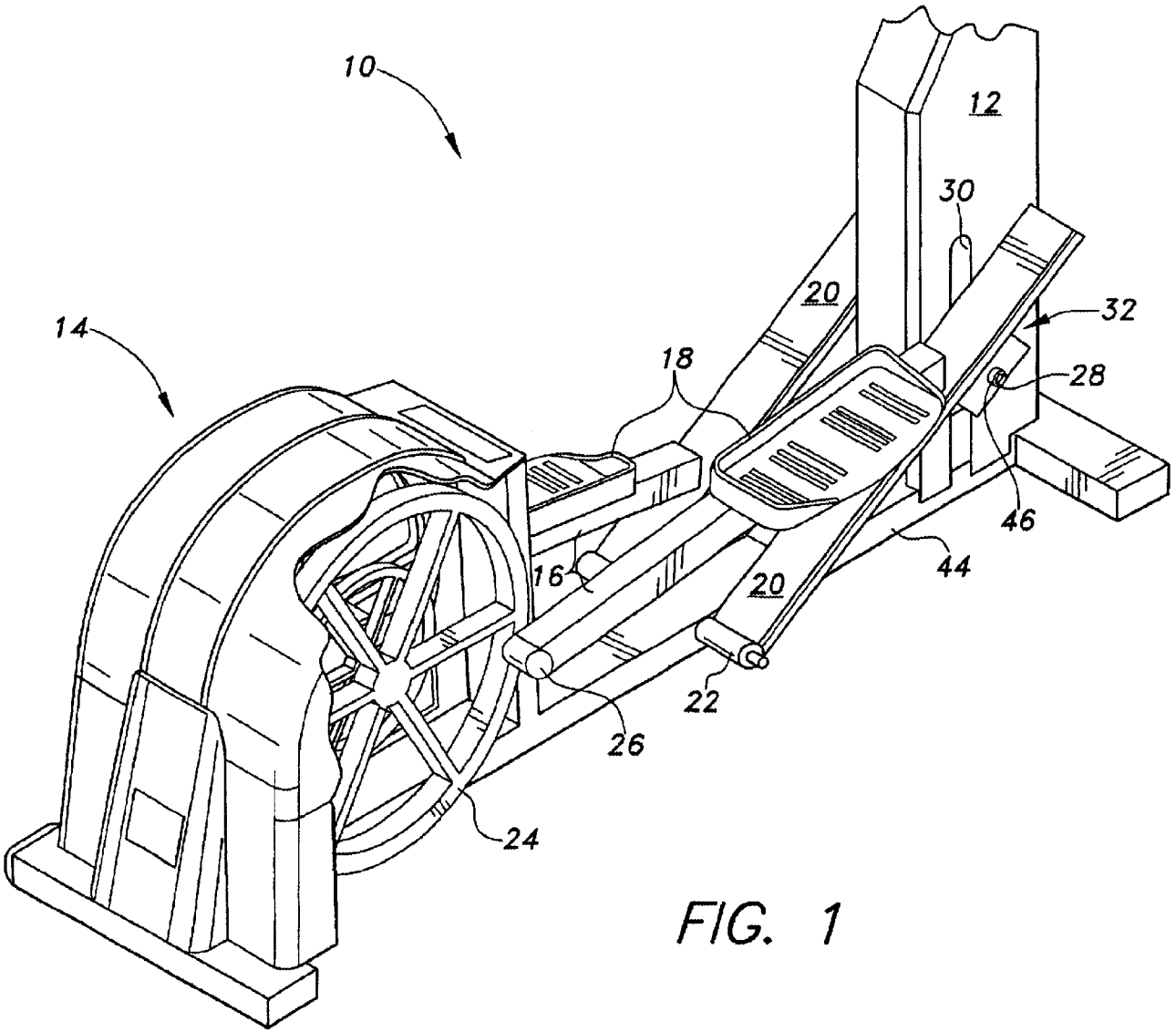
FIG. 1 is a perspective rear view of a portion of an improved leg exercise apparatus illustrating the stair arms on their ramps, and the flywheel assembly showing one flywheel pin and stair arm connection having substituted parts for the conventional bushing, all according to the present invention.
Figure 2:
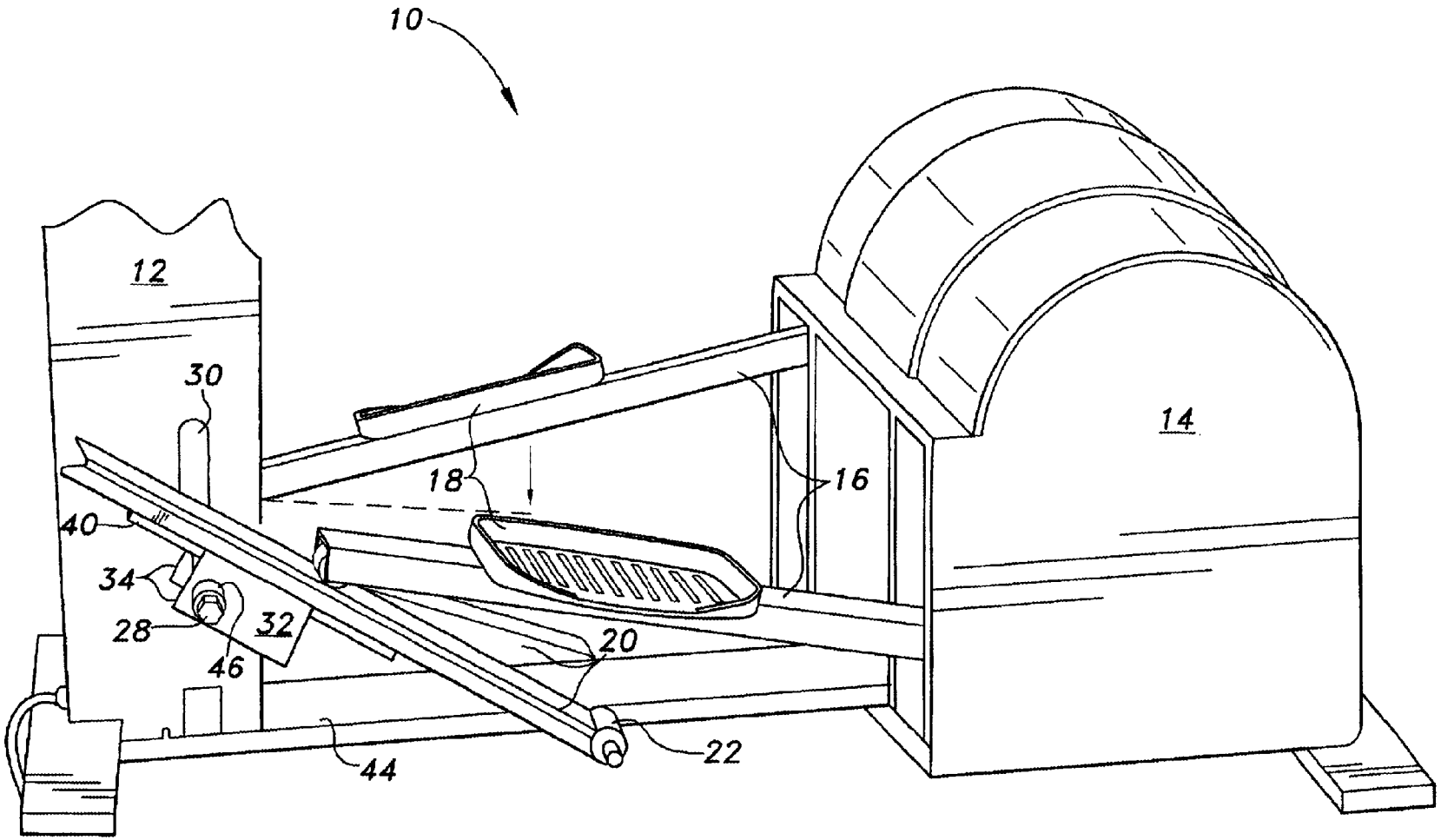
FIG. 2 is a partial left side perspective view of a portion of the improved exercise apparatus, and illustrating the reinforcement bracket under each ramp.

FIGS. 1 and 2 illustrate the modified exercise machine 10 minus the front handle and instrument panel in a front housing 12 and a rear housing 14. Housings 12 and 14 are connected by a frame piece, which is of welded, one-piece construction, and generally designated at 44. A pair of stair arms 16 with foot plates 18 ride on ramps 20 attached to frame 44 at 22, as shown. The distal ends of the stair arms 16 are connected to large diameter flywheels 24 inside both sides of the rear housing 14. So far, the explanation given is of entirely conventional parts, and thus a further detailed discussion is unnecessary.

The first improvement resides in supporting the ramps 20 in a manner and in a way not heretofore contemplated at all. Essentially, the improvement is to remove the lift motor 52 guide 58 and bracket 56 assembly from the position shown in FIG. 4, and place it beneath a ramp 20, at 40 and 32, as seen in the rest of the drawing figures. Of course, a second such guide and bracket assembly 40, 32, is provided for the other ramp 20. This modification results in two major advantages. One major advantage is that the original lift travel of 10 inches of the bracket 56 as mounted conventionally and shown in FIG. 4 is now reduced to about 2.5 inches, when mounted beneath ramp 20 as shown with bracket 32 riding on guide 40. This obviously reduces wear dramatically. Another great advantage is that now the ramp 20 is supported by structure extending all the way across the underside of ramp 20, as clearly indicated in FIG. 3. The relocation of the lift guide and bracket, joined with a new lower lift shaft of one piece design, joining both ramps, lift guides and brackets, and the original elevation motor's lift arm tube virtually eliminates the rocking motion imparted by the user to the original design, wherein each ramp 20 underside was supported only by a roller (or Delrin spacer), seen at R, FIG. 4. Now, since the entire machine is greatly strengthened by the improvements just explained, an improved, greatly smoother operation of the machine is the advantageous result for the user.

Figure 3:
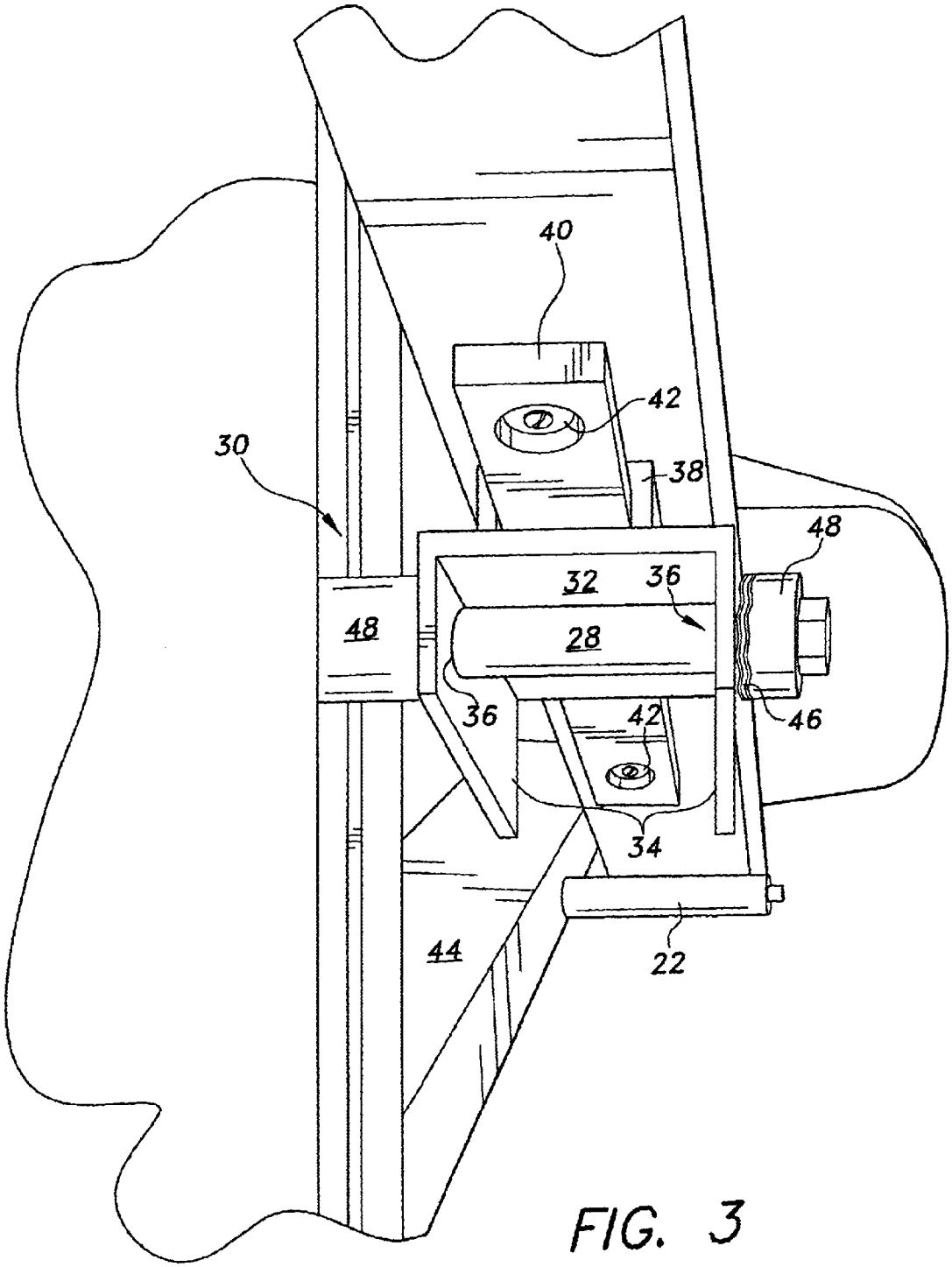
FIG. 3 is bottom perspective view of the reinforcement bracket under the left track, and drawn to an enlarged scale.

The first improvement structural details are best seen in FIGS. 2 and 3. The lift guide and bracket assembly about to be discussed is the same as the lift bracket 56 and guide 58 assembly (sold together as an assembly by Precor) shown in FIG. 4. In any event, U-shaped bracket 32 has two flanges 34 with apertures 36 and a supporting bracket 38, which is slidably mounted on the guide 40 which is secured to the bottom surface of each ramp 20 by recessed fasteners 42. The lower lift shaft 28 fits in the apertures 36 of the U-shaped bracket 32 to elevate and lower, or pivot the ramps 20 from 22, as best appreciated from FIG. 3. The guide brackets 32, of course, move uphill and downhill, sliding in their guides 40. Each U-shaped bracket 32 is confined onto the lower lift shaft 28 by at least three wave washers 46, and Delrin plastic spacers 48, held in place by the nut and washer assembly shown. A Delrin spacer 48 and additional wave washers (not shown) are located inside (to the left in the sense of FIG. 3) of guide bracket 32 as well. Thus, this second improvement is a synergistic advantage in substantially eliminating the rocking effect, by providing substantial support structure beneath each ramp 20, and decreasing the distance of travel for the guide brackets 32.

FIG. 4 illustrates conventional parts, including a worm screw 50 (hidden) of the motor lift 52, and the lift arm tube 54 in a guide bracket 56, and guide 58 assembly, which in turn is spaced from an upright post 60 since guide bracket 56 is attached to post 60. Again, it is this assembly 56, 58 which is removed and doubled to become the assemblies 32, 40, as aforesaid.

The original bushings present around the flywheel pin 26 deteriorate in use and cause vibration and a very loud squeaking of the connected mechanisms. This not only causes the original bushings to fail and wear out, but also causes scoring of the flywheel pins, which will also need to be replaced, all at a substantial repair cost to the consumer. Therefore, the second improvement which has substantially eliminated this problem consists of substituting the conventional bushings with needle or roller bearings and Oilite washers (or other self lubricating washers), all as indicated at 26.

The third improvement is the stabilizing of the lift motor 52, so that it does not move forward or backward. A number of pieces of Delrin (e.g., four) could be used, and/or other stabilizing means might be employed, provided the cost is kept low. The point in any event is simply to prevent the lift motor 52 from moving forward or backward.

It is to be understood that the present invention is not limited to the embodiment described above, but encompasses any and all embodiments within the scope of the following claims.

I claim:

1. In a leg exercising apparatus comprising a rear housing for oscillating two stair arms having foot plates by a pair of flywheels in the rear housing, and the stair arms supported by respective ramps connected to opposite sides of a front housing, and having lower lift shafts supporting the ramps, and moving said foot ramps by a lift motor raising and lowering a lift guide and bracket assembly in which the lift shafts are mounted, the improvement comprising a lift guide and bracket assembly located beneath each ramp, the lower lift shafts extended through a respective bracket of said lift guide and bracket assemblies, thus to minimize the travel of the brackets in their guides, and further provide stable support beneath each ramp, thereby decreasing the rocking movement of the ramps and the play from side to side of the stair arms, and greatly smoothing the operation of the leg exercising apparatus.

2. The improvement for a leg exercising apparatus as claimed in claim 1, further comprising wave washer and plastic spacer assemblies on the lower lift shafts to either side of the lift guide brackets.

3. The improvement for a leg exercising apparatus as claimed in claim 2, further comprising nut and washer assemblies for retaining the outboard ones of said wave washer and plastic spacer assemblies on the outer ends of the lower lift shafts.

4. The improvement for a leg exercising apparatus as claimed in claim 1, wherein the stair arms are connected to the flywheel by flywheel pins and are movably supported by the ramps by means of rollers located on the stair arms.

5. A leg exercising apparatus comprising a rear housing for oscillating two stair arms having foot plates by a pair of flywheels in the rear housing, and the stair arms supported by respective ramps connected to opposite sides of a front housing, and having lower lift shafts supporting the ramps, and moving said foot ramps by a lift motor raising and lowering a lift guide and bracket assembly in which the lift shafts are mounted, a lift guide and bracket assembly located beneath each ramp, the lower lift shafts extended through a respective bracket of said lift guide and bracket assemblies, thus to minimize the travel of the brackets in their guides, and further provide stable support beneath each ramp, thereby decreasing the rocking movement of the ramps and the play from side to side of the stair arms, and greatly smoothing the operation of the leg exercising apparatus; and wherein the stair arms are connected to the flywheel by flywheel pins and are movably supported by the ramps by means of rollers located on the stair arms.

6. The leg exercising apparatus as claimed in claim 5 further comprising wave washer and plastic spacer assemblies on the lower lift shafts to either side of the lift guide brackets.

7. The leg exercising apparatus as claimed in claim 6, further comprising nut and washer assemblies for retaining the outboard ones of said wave washer and plastic spacer assemblies on the outer ends of the lower lift shafts.

8. A leg exercising apparatus comprising:

a rear housing for oscillating two stair arms having foot plates by a pair of flywheels in the rear housing, and the stair arms supported by respective ramps connected to opposite sides of a front housing;

a front housing having lower lift shafts supporting the ramps, and moving said foot ramps by a lift motor raising and lowering a lift guide and bracket assembly in which the lift shafts are mounted;

a lift guide and bracket assembly located beneath each ramp, the lower lift shafts extended through a respective bracket of said lift guide and bracket assemblies, thus to minimize the travel of the brackets in their guides, and further provide stable support beneath each ramp, thereby decreasing the rocking movement of the ramps and the play from side to side of the stair arms, and greatly smoothing the operation of the leg exercising apparatus; and wherein the stair arms are connected to the flywheel by flywheel pins and are movably supported by the ramps by means of rollers located on the stair arms.

9. The leg exercising apparatus as claimed in claim 8, further comprising wave washer and plastic spacer assemblies on the lower lift shafts to either side of the lift guide brackets.

10. The leg exercising apparatus as claimed in claim 9, further comprising nut and washer assemblies for retaining the outboard ones of said wave washer and plastic spacer assemblies on the outer ends of the lower lift shafts.

* * * * *